US010254065B2

(12) United States Patent
Dionne

(10) Patent No.: US 10,254,065 B2
(45) Date of Patent: Apr. 9, 2019

(54) SYSTEMS AND METHODS FOR A FIREARM CONVERSION KIT WITH SLAVED EJECTOR

(71) Applicant: General Dynamics Ordnance and Tactical Systems—Canada, Inc., Repentigny (CA)

(72) Inventor: Sylvain Dionne, Repentigny (CA)

(73) Assignee: General Dynamics Ordnance and Tactical Systems—Canada, Inc., Repentigny (CA)

( * ) Notice: Subject to any disclaimer, the term of this patent is extended or adjusted under 35 U.S.C. 154(b) by 0 days.

(21) Appl. No.: 15/790,727

(22) Filed: Oct. 23, 2017

(65) Prior Publication Data

US 2018/0313622 A1 Nov. 1, 2018

Related U.S. Application Data

(60) Provisional application No. 62/415,366, filed on Oct. 31, 2016.

(51) Int. Cl.
*F41A 15/10* (2006.01)

(52) U.S. Cl.
CPC ..... *F41A 15/10* (2013.01)

(58) Field of Classification Search
CPC ..... F41A 15/10; F41A 15/00; F41A 15/12; F41A 15/14; F41A 15/16; F41A 33/00; F41A 11/02
USPC ..... 42/16, 46, 47
See application file for complete search history.

(56) References Cited

U.S. PATENT DOCUMENTS 1,376,456 A * 5/1921 Moore ..... F41A 5/16 42/11
3,882,625 A * 5/1975 Tellie ..... F41A 3/12 42/25
3,967,404 A * 7/1976 Reynolds ..... F41A 15/14 42/25
4,803,911 A * 2/1989 Morini ..... F41A 9/18 89/194
4,907,489 A * 3/1990 Teague ..... F41A 21/26 89/14.5

(Continued)

FOREIGN PATENT DOCUMENTS

AT 613980 A4 9/2014

OTHER PUBLICATIONS

German Patent and Trademark Office, Search Report for Application No. 102017125441.2, dated Aug. 29, 2018.

(Continued)

*Primary Examiner* — John Cooper
(74) *Attorney, Agent, or Firm* — LKGlobal | Lorenz & Kopf, LLP

(57) ABSTRACT

A slide for a weapon conversion kit of the type used in conjunction with a firearm having a stock ejector and configured to fire ammunition is provided. The slide includes a slide body and a slaved ejector member rotatably coupled to the slide body. The slaved ejector member has a first portion and a second portion, the second portion including a contact region. The slaved ejector member is configured to contact the stock ejector when the slide body slides rearward in response to firing of the firearm and thereby causes the contact region of the second portion of the slaved ejector member to eject a cartridge case of the ammunition.

9 Claims, 3 Drawing Sheets

(56) References Cited

U.S. PATENT DOCUMENTS

| | | | | |
|---|---|---|---|---|
| 5,227,578 | A * | 7/1993 | Reynolds | F41A 3/34 89/186 |
| 5,433,134 | A | 7/1995 | Leiter | |
| 6,276,252 | B1 | 8/2001 | Dionne | |
| 6,732,465 | B2 | 5/2004 | Strayer | |
| 7,478,494 | B2 * | 1/2009 | Zeh | F41A 15/14 42/25 |
| 8,061,255 | B1 * | 11/2011 | Boberg | F41A 9/23 42/16 |
| 8,381,425 | B2 | 2/2013 | Emde | |
| 9,435,598 | B2 * | 9/2016 | Seckman | F41A 9/62 |
| 2004/0055198 | A1 * | 3/2004 | Gussalli Beretta | F41A 15/14 42/46 |
| 2011/0168009 | A1 * | 7/2011 | Robb | F41A 3/54 89/194 |
| 2011/0219656 | A1 * | 9/2011 | McGarry | F41A 11/00 42/70.06 |
| 2014/0196339 | A1 * | 7/2014 | Zukowski | F41A 15/14 42/25 |
| 2017/0160040 | A1 * | 6/2017 | Dionne | F41A 21/00 |

OTHER PUBLICATIONS

Intellectual Property Office, Combined Search and Examination Report under Sections 17 and 18(3) for United Kingdom Patent Application No. GB1717657.9 dated Apr. 27, 2018.

The Austrian Patent Office, Office Action for Austrian Patent Application No. 2A A 50909/2017-1 dated May 3, 2018.

* cited by examiner

SYSTEMS AND METHODS FOR A FIREARM CONVERSION KIT WITH SLAVED EJECTOR

CROSS-REFERENCE TO RELATED APPLICATIONS

This application claims priority to U.S. Provisional Pat. No. 62/415,366, filed Oct. 31, 2016, the contents of which are hereby incorporated by reference.

TECHNICAL FIELD

The technical field generally relates to firearms. More particularly, the technical field relates to systems and methods for converting firearms for the purpose of training.

BACKGROUND

Military and law enforcement organizations often seek to employ low-energy training ammunition having a shorter range and lower terminal effect than standard, service ammunition. In order to facilitate such training, it is desirable to modify the standard or "stock" firearm in order to be able to reliably fire this low-energy training ammunition. Many thousands of weapon conversion kits have been produced and sold in recent years and due to the increasing use of metal injection molded (MIM) components and light-weight polymer materials for weapon receiver and frame parts, more complex geometrical weapon designs are now possible. This has led to more complicated conversion kit designs, which now more frequently require changing out the service or stock weapon slide as well as changing out the original barrel for a training barrel.

Currently known conversion kits often face reliability problems due to improper ejection of the fired cartridge case. Since the reduced energy cartridges are ejected from the converted weapon using the straight blowback principle, the energy required to cycle the weapon is generated only from the rearward piston motion of the reduced energy cartridge case against the weapon breech face (see, for example, U.S. Pat. No. 5,359,937).

Furthermore, because the converted weapon includes a conversion barrel that is not locked with the slide of the service pistol frame, the training barrel moves differently than a service barrel during use, which creates an offset between the firing pin/striker and the centerfire primer of the training cartridge.

During normal use, firing a standard, unconverted weapon will cause the muzzle end of the service barrel to tilt upward after chambering of the standard ammunition, whereas the unlocked training barrel makes no tilting movement upward, which makes feeding the training ammunition into the conversion kit chamber more challenging.

When conventional ammunition is fired from a weapon with a standard barrel and slide, the chamber end tilts downwards for feeding of ammunition, it thus presents the chamber in an optimal position versus the weapon magazine for feeding of the cartridge, then it tilts upwards again for the striker or firing pin to properly impact the centrally located primer of a cartridge in the chamber. After firing, the barrel moves rearwardly with the slide, then unlocks and the chamber end of said barrel tilts downwards once again so that the fired cartridge case can be properly extracted, can hit the ejector, and can be finally ejected from the weapon (when the slide recoils rearwardly). This normally occurs with conventional ammunition with the assistance of an ejector that is part of the weapon frame assembly. The position of the ejector ensures that it is able to impact sufficient surface area of the rim of the fired conventional cartridge case such that it is reliably ejected from the ejection port of the weapon.

In order for a converted weapon to function reliably for training, it must be capable of properly feeding the training ammunition from the magazine to the feed ramp. In this regard, some weapon conversion kits require an additional, detachable feed ramp (see, for example, U.S. Pat. No. 6,276,252) for the ammunition to be properly positioned for the firing pin to properly impact the centerfire primer for reliable ammunition function and then finally for the stock ejector to properly hit the cartridge case rim of the fired shell casing afterwards for proper ejection. All of the resulting alignment details are more complex with a non-tilting conversion barrel, leading to a range of design compromises.

First, the firing pin in such conversion kit sometimes needs to be offset (with respect to the stock firing pin) to ensure sufficient impact on the primer of the training ammunition. This often requires unusual firing pin designs and/or positioning to mitigate the lack of barrel tilting, but also increases production costs while creating potential design weaknesses. Second, the non-tilting barrel presents less surface area for the ejector to impact the cartridge case of the fired training round.

In order to eject the fired cartridge case properly, there must be sufficient material overlap between the rim of the cartridge case and the ejector. This is not always the case with converted weapons because the position of the fired cartridge case is no longer in the same plane as the ejector and is thus a potential cause for increased stoppages and reduced weapon reliability.

There is a long-felt need for conversion kits that provide proper ejection, but which also permit proper firing pin/striker impact on the training ammunition primer. Off-center impacts are often the cause of misfires, which cause weapon stoppages. The majority of pistols have a fixed ejector that is attached to the weapon frame, a part of the weapon which is not normally modified for training purposes. Since it is normally fixed, the ejector position is a given and thus the firing pin (or striker) becomes the component of the conversion kit that is moved as required to compensate the offset (as much as physically possible) for more reliable functioning. However, the maximum possible distance that the firing pin can be offset in the training slide is limited by the amount of material in the weapon, due to geometrical constraints.

Accordingly, there is a trade-off between having a good, solid firing pin impact on the centerfire primer and being able to reliably eject the cartridge case, due to the limits of weapon geometry.

The firing pin/striker of an unmodified weapon is oriented on the central axis of the service ammunition when the ammunition is present in the chamber of the tilted barrel and thus is in direct line with its centrefire primer. This is not the case with a weapon with a non-tilting conversion kit and so even offset firing pins can still generate insufficient primer strikes and thus misfires.

Even if primer initiation and cartridge case ejection is successful, the ejection energy may vary due to design constraints imposed by the geometry of the converted weapon. Marginal contact between the ejector and the cartridge case may result in weak ejection from the training weapon. Weak cartridge case ejection is a symptom of a marginal design condition and possible stoppages to come and this affects the trainee's perception of the weapon performance and reliability and thus the realism of the training.

Due to the geometry constraints of some converted weapons, it has previously been required to provide modified firing pins/strikers with conversion kits in order to attempt to overcome the offset caused by the non-tilting barrel to properly impact the primer. These unique conversion kit firing pins/strikers are sometimes positioned on an angle (versus the longitudinal axis of the conversion slide) to assist with firing pin impact on the primer. Sometimes the conversion kit firing pins tips have required a modified tip geometry to compensate for the offset, sometimes resulting in an asymmetrical in form, having a "shark fin" design or being completely offset, with the firing pin tip in a plane parallel to but below the central longitudinal axis of the firing pin. The shark fin firing pin tip design has the disadvantage of presenting a sharp tip (rather than the standard round head tip design) which has been shown to occasionally cause pierced primers, which is unsatisfactory. The offset firing pin tip designs also have the disadvantage of generating a bending moment on the offset arm of the firing pin, which can lead to breakages of the firing pin.

Another method that has been introduced to improve cartridge case ejection is to fix (by welding or by pinning) a new, supplementary ejector directly onto the conversion barrel, at the lower chamber end. This method helps ensure proper contact with the cartridge case rim, but has the disadvantages of being more costly to produce and of introducing a long, thin element that can be easily bent or broken by the trainee during the process of converting the weapon for training or when restoring it to operational service condition. Further, such ejectors are located inside the frame or slide of the stock weapon, which has its own inherent geometry variations, and thus is also limited in its application due to spatial constraints in some weapons.

Accordingly, there is a long-felt need for firearm conversion kits with improved ejector systems that can address the above limitations of the prior art. Other desirable features and characteristics of the present invention will become apparent from the subsequent detailed description and the appended claims, taken in conjunction with the accompanying drawings and the foregoing technical field and background.

BRIEF SUMMARY

In accordance with various embodiments, a slide for a weapon conversion kit of the type used in conjunction with a firearm having a stock ejector and configured to fire ammunition is provided. The slide includes a slide body and a slaved ejector member rotatably coupled to the slide body. The slaved ejector member has a first portion and a second portion, the second portion including a contact region. The slaved ejector member is configured to contact the stock ejector when the slide body slides rearward in response to firing of the firearm and thereby causes the contact region of the second portion of the slaved ejector member to eject a cartridge case of the ammunition.

In accordance with one embodiment, a firearm kit includes: a firearm configured to fire ammunition, the firearm having a stock ejector and a stock slide; and a conversion slide configured to replace the stock slide of the firearm, the conversion slide including a slide body and a slaved ejector member rotatably coupled to the slide body, the slaved ejector member having a first portion and a second portion, the second portion including a contact region, wherein the slaved ejector member is configured to contact the stock ejector when the slide body slides rearward in response to firing the firearm and thereby causes the contact region of the second portion of the slaved ejector member to eject a cartridge case of the ammunition.

In one embodiment, a firearm includes a stock ejector and a conversion slide provided in place of a stock slide of the firearm, the conversion slide including a slide body and a slaved ejector member rotatably coupled to the slide body, the slaved ejector member having a first portion and a second portion, the second portion including a contact region; wherein the slaved ejector member is configured to contact the stock ejector when the slide body slides rearward in response to firing the firearm and thereby causes the contact region of the second portion of the slaved ejector member to eject a cartridge case of the ammunition.

BRIEF DESCRIPTION OF THE DRAWINGS

The exemplary embodiments will hereinafter be described in conjunction with the following drawing figures, wherein like numerals denote like elements.

DETAILED DESCRIPTION

In general, the subject matter described herein relates to an improved conversion kit slide including a slaved ejector that overcomes the limitations of the prior art by being actuated by the rearward motion of the conversion slide as it passes over the existing ejector of the host or stock weapon frame during cycling. That is, the improved ejector is "slaved" to (i.e., actuated by) the rearward motion of the conversion slide relative to the stock ejector.

As a preliminary matter, there is no intention to be bound by any expressed or implied theory presented in the preceding technical field, background, brief summary or the following detailed description. Embodiments of the present disclosure may be described herein in terms of functional and/or logical block components and various processing steps. In addition, those skilled in the art will appreciate that embodiments of the present disclosure may be practiced in conjunction with any number of systems, and that the designs described herein are merely various exemplary embodiments of the present disclosure. For the sake of brevity, conventional techniques related to firearms, conversion kits, ammunition, and other functional aspects of the systems (and the individual operating components of the systems) may not be described in detail herein.

Figure 1:
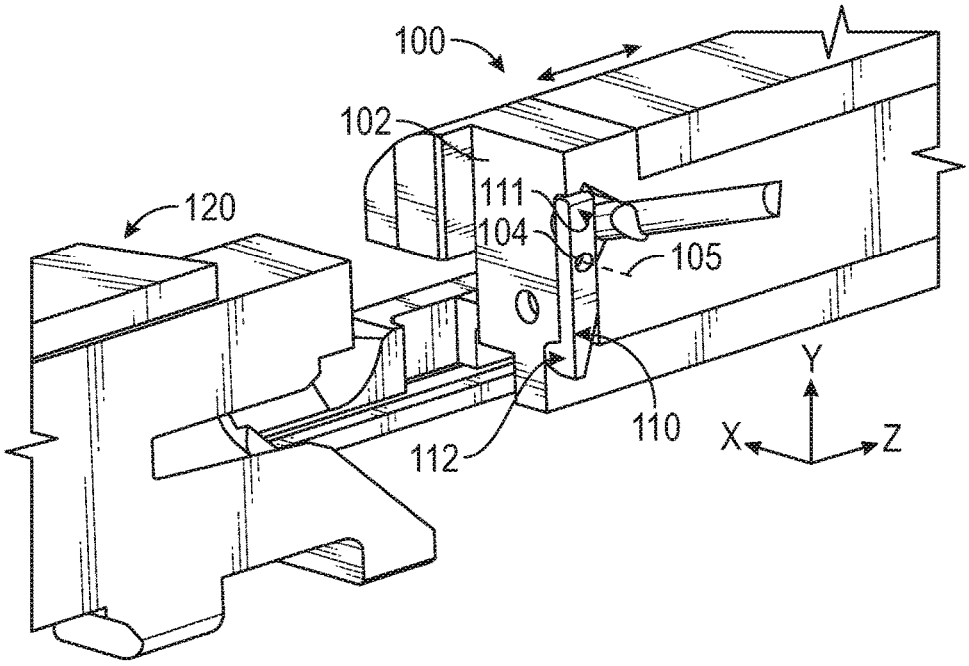
FIG. 1 is an isometric section view of a conversion kit slide with slaved ejector in resting mode, in accordance with one embodiment.

Referring now to FIG. 1, an exemplary conversion kit slide (or simply "conversion slide" or "slide") 100 will be described. As will be understood, slide 100 is suitably configured to translate respect to a barrel assembly 120 (left and right along the z-axis in FIG. 1) due to the presence of rails or other mechanical constraints. Specifically, slide 100 is configured to move to the right during "blowback" resulting from firing of the low-energy cartridge.

As shown, slide 100 generally includes a slave ejector member (or simply "ejector member" or "member") 110 rotatably secured to slide 100 via a pin or other pivot component 104 defining a rotational axis 105 relative to the body of ejector member 110. Ejector member 110 has a first (or "upper") portion 111 and a second (e.g., "lower") portion 112. In this state (the "rest state") ejector member 110 is held in place within slide 100 via a suitable retaining force (e.g., via a spring as shown in the subsequent drawings). Other components that provide a retaining force may alternatively be employed.

In some embodiments, the rest state ejector member 110 fits within slide 100 such that it does not extend beyond the breech face 102 of slide 100 (i.e., along negative z-axis as illustrated in FIG. 1). In a particular embodiment, ejector member 110 has a surface that is substantially flush with breech face 102.

Figure 2:
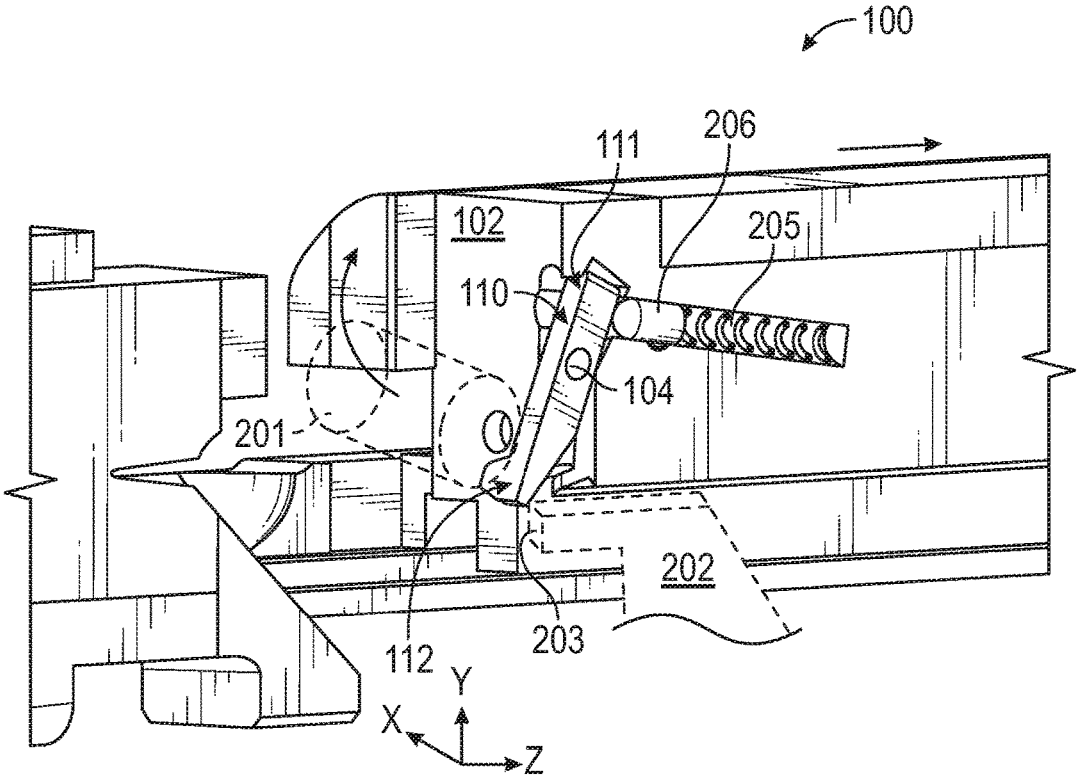
FIG. 2 is an isometric section view of the conversion kit slide of FIG. 1 in an ejection mode.

FIG. 2 is an isometric section view of the conversion kit slide of FIG. 1 in an "ejection mode." Specifically, this figure illustrates ejector member 110 in a (clockwise) rotated position relative to the rest mode of FIG. 1. As shown, the rotation of ejector member 110 is opposed by a spring 205 that provides a force on the backside of upper portion 111 of ejector member 110 and causes member 110 to spring back to its rest position after actuation. It should be noted that ejector member 110 may be opposed by the spring (205) force acting on a plunger (206) or other such intermediate structure. Also shown in FIG. 2 is the stock ejector 202 that is, as mentioned above, fixed to the frame of the firearm and which impinges (at 203) upon the backside of the bottom portion 112 of stock ejector 202 as slide 100 moves backward (to the right in the figure).

As a result of the rotation of ejector member 110, bottom region 112 contacts and helps to eject a cartridge case 201 (illustrated by the arrow leading from cartridge case 201). Thus, as can be seen, ejector member 110—through its interaction with stock ejector 202—effectively provides an increased area at the correct offset position to affect ejection of cartridge case 201.

Figure 3:
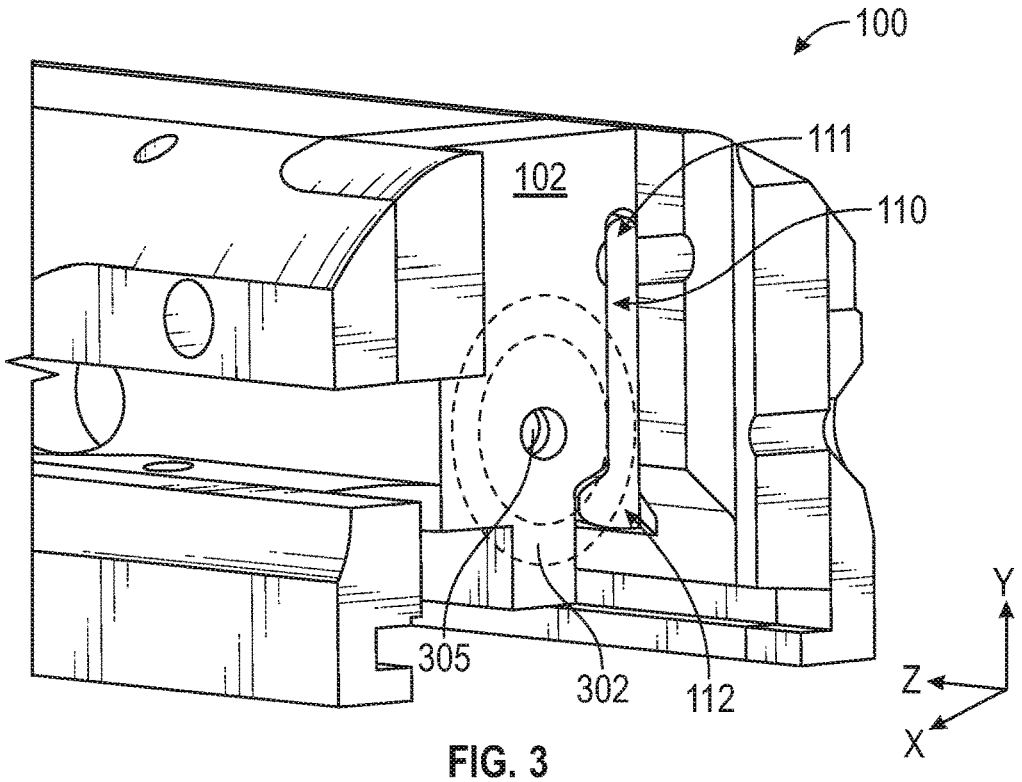
FIG. 3 is an isometric overview of the conversion kit slide of FIG. 1 in accordance with one embodiment.

FIG. 3 provides another isometric section overview of the conversion kit slide 100 of FIG. 1 in a resting mode. This figure shows a ring-shape range of diameters (302) extending from a center 305 (corresponding to a firing pin location) that might be contacted by lower portion 112 of ejector member 110. That is, the ejector member 110 of FIG. 3 would be most effective in ejecting cartridge cases having outer diameters in the illustrated range due to the shape of bottom region 112 of ejector member 110. It can be seen that slaved ejector 110 acts as a surface area augmenter and thus results in more effective contact with the fired cartridge case 201 rim, thus greatly enhancing ejection reliability.

Figure 4:
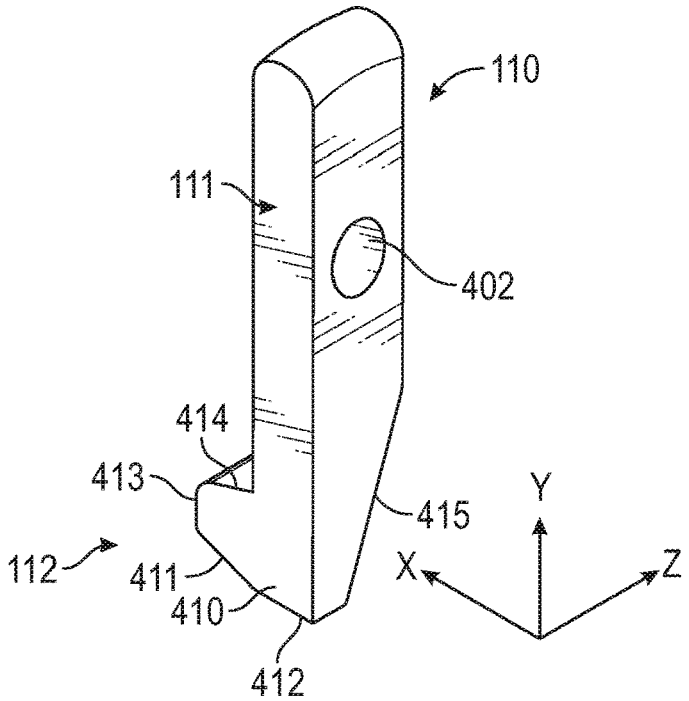
FIG. 4 is an isometric view of an exemplary slaved ejector member in accordance with one embodiment.

FIG. 4 presents a close-up view of a slaved ejector member 110 in accordance with a particular embodiment. As shown, member 110 includes a bore 402 configured to rotatably accept the pivot component 104 of FIGS. 1-2. In this embodiment, member 110 includes a tapered back surface 415 configured to contact the stock ejector 202 (shown in FIG. 2). Member 110 also includes a "hockey-stick" or "J-shaped" bottom region 112 defined by a contact face 410 configured to contact and assist in ejecting the cartridge case 201 (FIG. 2). In other embodiments, bottom region 112 is "paddle shaped" or simply of a wider, substantially constant width. Contact face 410 is bounded by a top edge 414 (which may be sloped, as shown), a distal edge 413, a bottom edge 412, and a beveled edge 411 as shown.

In general, it will be appreciated that the design of slide 100 in FIG. 1 will include a modified breech face structure that can accommodate the shape of bottom region 412 (and indeed the entirety of member 110) within the confines of breech face 102 such that contact face 410 is substantially flush with breech face 102.

Figure 5:
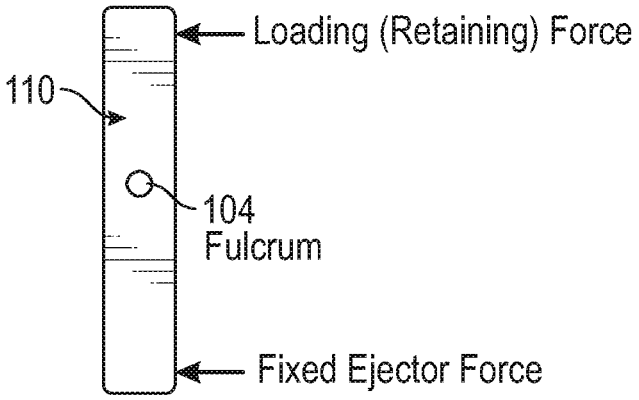
FIGS. 5-7 depict various free-body diagrams of exemplary slaved ejector members in accordance with various embodiments.
Figure 6:
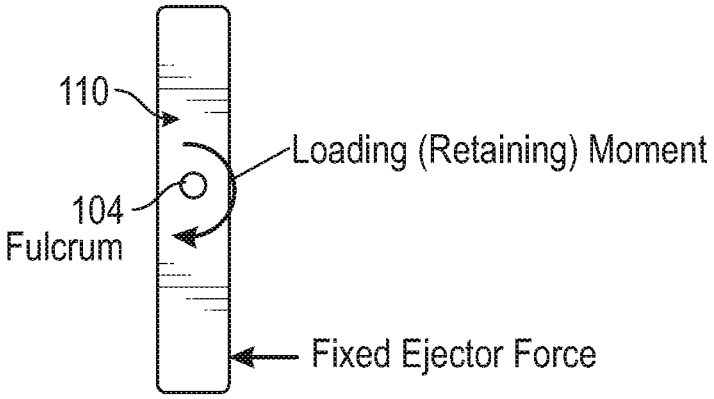

While the above figures illustrate an embodiment wherein the top portion 111 of member 110 rotates about a central pivot component 104 and is constrained via a compressive force applied to the backside of upper portion 111, the invention is not so limited, and any form of constrained lever configuration may be used. In that regard, FIGS. 5-6 depict simplified free-body diagrams of exemplary slaved ejector members in accordance with various embodiments. Specifically, FIG. 5 depicts the mode of operation shown in FIGS. 1 and 2, wherein the loading force is applied to the top portion and the stock ejector force is applied to the bottom portion of member 110, resulting in selective rotation around pivot component 104. FIG. 6, on the other hand, shows the case where the loading force comprises a rotational moment provided, for example, by a torsion spring or other such component.

Figure 7:
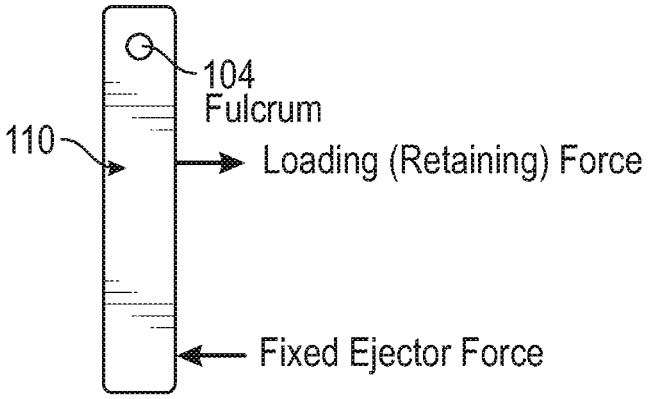

Finally, FIG. 7 illustrates the case in which the pivot component 104 is located near the top of member 110 and the opposing loading force and stock ejector force occur below the pivot component 104. It will be appreciated that the embodiments shown in FIG. 5-7 are not intended to be limiting, and that any mechanical assembly that allows member 110 to eject the cartridge case by virtue of interaction with the stock ejector may be employed. That is, the present invention contemplates any "slaved" arrangement of a moveable conversion kit ejector configured to interact with a stock ejector.

Ejector member 110 may be manufactured using a variety of materials, including a rigid metal, such as steel, brass or aluminum, high strength polymers, or the like. In some embodiments, steel is a particularly advantageous material due to its strength, cost and manufacturing ease.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A slide for a weapon conversion kit of the type used in conjunction with a firearm having a stock ejector and configured to fire ammunition, the slide including:

a slide body; and a slaved ejector member rotatably coupled to the slide body, the slaved ejector member having a first portion and a second portion, the second portion including a contact region;

wherein the slaved ejector member is configured to contact the stock ejector when the slide body slides rearward in response to firing of the firearm and thereby causes the contact region of the second portion of the slaved ejector member to eject a cartridge case.

2. The slide of claim 1, wherein the slaved ejector member has a surface that is substantially flush with a breech face of the slide body in a resting state.

3. The slide of claim 1, wherein the second portion of the slaved ejector member is generally "J" shaped.

4. The slide of claim 1, wherein the second portion has an arcuate contact surface to reduce binding when contacting the stock ejector.

5. The slide of claim 1, wherein the slaved ejector member is manufactured from a material selected from the group consisting of steel, aluminum, brass, and polymers.

6. The slide of claim 1, further including a spring component coupled to the first portion of the slaved ejector member to constrain the slaved ejector member to the slide body in the resting state.

7. A firearm configured to fire ammunition, the firearm comprising:

a stock ejector; and a conversion slide provided in place of a stock slide of the firearm, the conversion slide including a slide body and a slaved ejector member rotatably coupled to the slide body, the slaved ejector member having a first portion and a second portion, the second portion including a contact region;

wherein the slaved ejector member is configured to contact the stock ejector when the slide body slides rearward in response to firing the firearm and thereby causes the contact region of the second portion of the slaved ejector member to eject a cartridge case.

8. A firearm kit comprising:

A firearm configured to fire ammunition, the firearm having a stock ejector and a stock slide;

a conversion slide configured to replace the stock slide of the firearm, the conversion slide including a slide body and a slaved ejector member rotatably coupled to the slide body, the slaved ejector member having a first portion and a second portion, the second portion including a contact region, wherein the slaved ejector member is configured to contact the stock ejector when the slide body slides rearward in response to firing the firearm and thereby causes the contact region of the second portion of the slaved ejector member to eject a cartridge case.

9. The firearm kit of claim 8, further including a training ammunition cartridge configured to be fired by the firearm when outfitted by the conversion slide.

* * * * *